US005864108A

United States Patent [19]

Röhling et al.

[11] Patent Number: 5,864,108

[45] Date of Patent: Jan. 26, 1999

[54] VACUUM SWITCH ASSEMBLY INCLUDING HOUSING INSULATING SUPPORT

[75] Inventors: Christoph Röhling; Claudia Sigusch, both of Berlin; Norbert Steinemer, Falkensee, all of Germany

[73] Assignee: Siemens Aktiengesellschaft, München, Germany

[21] Appl. No.: 750,229

[22] PCT Filed: May 29, 1995

[86] PCT No.: PCT/DE95/00710

§ 371 Date: Nov. 26, 1996

§ 102(e) Date: Nov. 26, 1996

[87] PCT Pub. No.: WO95/33273

PCT Pub. Date: Dec. 7, 1995

[30] Foreign Application Priority Data

May 30, 1994 [DE] Germany ..... 44 19 380.7

[51] Int. Cl.[6] ..... H01H 33/66

[52] U.S. Cl. ..... 218/134; 218/139

[58] Field of Search ..... 218/118–140

[56] References Cited

U.S. PATENT DOCUMENTS

| | | | |
|---|---|---|---|
| 3,859,486 | 1/1975 | Haese et al. | 218/138 X |
| 4,527,028 | 7/1985 | Luehring | 218/140 X |
| 4,540,862 | 9/1985 | Jahrig et al. | 218/118 |
| 4,614,850 | 9/1986 | Kuhl et al. | 218/136 |
| 4,618,749 | 10/1986 | Bohme et al. | 218/134 |
| 5,015,809 | 5/1991 | Wiithrich | 218/119 |
| 5,191,180 | 3/1993 | Kitamura et al. | 218/135 |
| 5,508,486 | 4/1996 | Spack et al. | 218/119 X |
| 5,521,348 | 5/1996 | Berndt et al. | 218/139 X |
| 5,528,009 | 6/1996 | Marquardt et al. | 218/140 |
| 5,767,451 | 6/1998 | Rohling et al. | 174/158 R |

FOREIGN PATENT DOCUMENTS

| | | | |
|---|---|---|---|
| 0 450 397 A2 | 10/1991 | European Pat. Off. | H01H 33/02 |
| 0 564 057 A1 | 10/1993 | European Pat. Off. | H01H 33/66 |
| 34 36 173 A1 | 3/1986 | Germany | H02B 13/02 |
| 42 10 716 A1 | 9/1993 | Germany | H01H 33/66 |
| 42 11 154 A1 | 10/1993 | Germany | H02B 13/035 |
| U 94 09 006 | 9/1994 | Germany | H02B 13/00 |
| WO 93/20571 | 10/1993 | WIPO | H01H 33/66 |

*Primary Examiner*—J. R. Scott
*Attorney, Agent, or Firm*—Kenyon & Kenyon

[57] ABSTRACT

A power switch module designed to be mounted in gas-filled containers of gas-insulated switchgear is provided, wherein each vacuum switch tube of the power switch has a corresponding rectilinearly movable actuating rod leading into the gas-filled container through a bellows-type seal. The power switch module includes two insulating support devices arranged symmetrically on a partition, between which the corresponding vacuum switch tubes supported by a pole support device and a pole head device. Such power switch modules are used in gas-insulated switchgears.

3 Claims, 3 Drawing Sheets

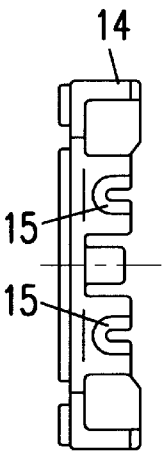
FIG. 3C
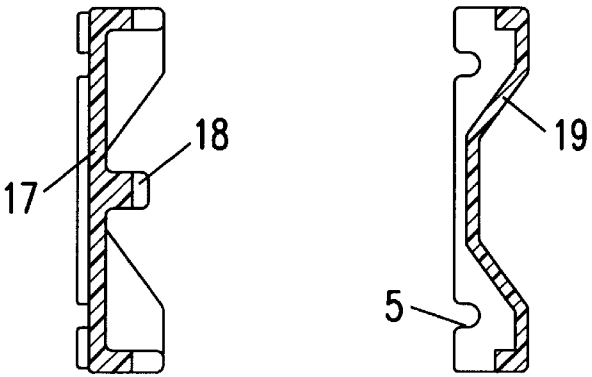
FIG. 5
FIG. 4
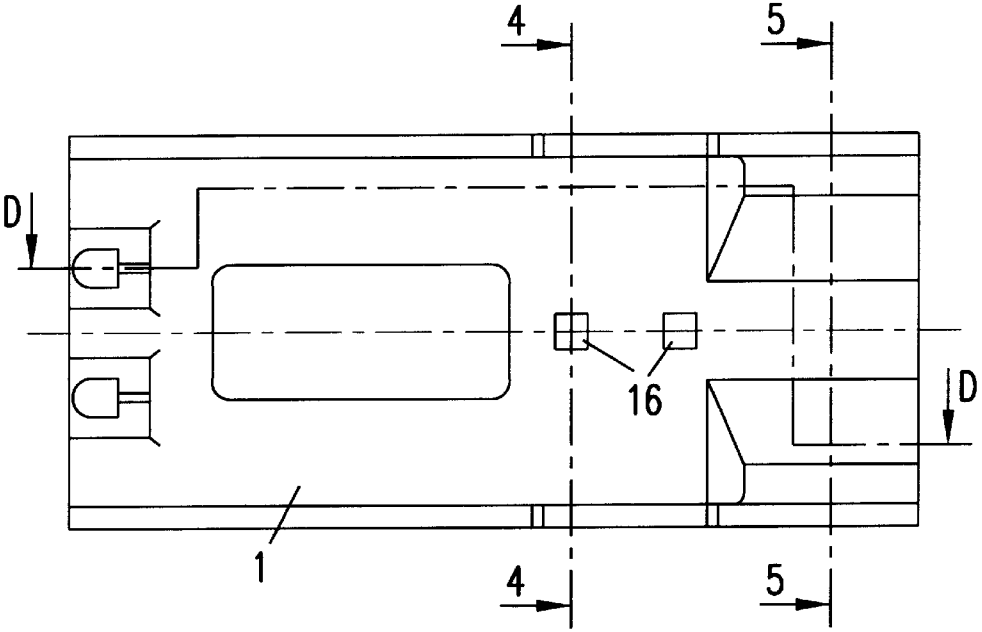
FIG. 3A
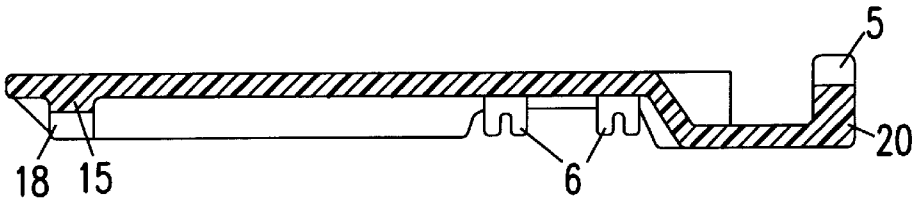
FIG. 3B

VACUUM SWITCH ASSEMBLY INCLUDING HOUSING INSULATING SUPPORT

FIELD OF THE INVENTION

The present invention relates to a power switch module designed to be mounted in gas-filled containers of gas-insulated switchgear, wherein each vacuum switch tube has a corresponding rectilinearly movable actuating rod leading into the gas-filled container through a bellows-type seal.

BACKGROUND OF THE INVENTION

A gas-insulated switchgear of the type mentioned above is known from German Patent No. 4,211,154 A1. According to this reference, the power switches designed as vacuum switch tubes are fastened to an insulating plate using two supports, with the insulating plate being in turn connected to the front and rear walls of the container through angle brackets. Furthermore, an additional insulating plate arranged under the vacuum switch tubes, similarly fastened to the inner walls of the container, serves for additional fastening of the vacuum switch tubes within the container. The insulating plates are dimensioned so that the vacuum switch tubes are accessible during assembly at the points required therefor and the insulating gas can circulate sufficiently around the vacuum switch tubes during operation.

German Patent No. 3,436,173 A1 discloses a power switch mounted on the inside of the front wall of a metal capsule filled with insulating gas, in a housing made of insulating material. No sealed bellows are, however, provided here for feed-through. German Patent No. 4,210,716 A1, on the other hand, discloses a multipole vacuum switch whose poles are surrounded with shell-type insulating pieces. These vacuum switches are not, however, mounted in gas-filled containers.

OBJECTS AND SUMMARY OF THE INVENTION

One object of the present invention is to facilitate the attachment and assembly of vacuum switch tubes inside the container without, however, adversely affecting the technical parameters of the vacuum switch tube insulations in relation to one another and in relation to surrounding components. According to the invention, this is achieved with the following features:

1.1 the power switch module contains two insulating support devices with the same profile structure to accommodate and shield vacuum switch tubes, 1.2 the insulating support devices are arranged symmetrically on one part of the partition plate forming a part of the gas-filled container and are removably fastened thereto, 1.3 the insulating support devices have two first screw beds arranged symmetrically in relation to a longitudinal axis at their free ends for fastening a pole head device radially supporting the vacuum switch tubes in the outer end area, and 1.4 the insulating support devices have two adjacent second screw beds in the inner area opposite one another in relation to a longitudinal axis for fastening a pole support device which supports the vacuum switch tubes in the inner end area.

With such a design of the insulating support devices, the vacuum switch tubes are largely independent of the geometrical shape of the container in which they are located. Only the partition plate representing a part of the gas-filled container serves as a mounting base for the insulating support devices. The modular design of the power switches considerably facilitates pre-assembly, which can thus performed in substantially smaller volume units, which makes the final assembly, carried out at different times and/or in different places, more cost-effective.

With the pole support device and pole head device arranged between the two insulating support devices, the vacuum switch tubes are securely fastened in the container with almost identical fastening elements. The screw beds create a more flexible assembly of the vacuum switch tubes within the container, which can be disassembled at any time.

An advantageous embodiment of the invention provides the following features:

2.1 the insulating support devices have a trapezoidal profile in the end area facing the partition plate, and 2.2 the first and second screw beds of the insulating support devices are provided with stops each semi-enclosing a bolt barrel.

The trapezoidal profile on both sides of the insulating support devices provides the supports with considerable stability and provides the vacuum tubes with exact positioning with the actuator rods movable in the bellows; the stops semi-enclosing the bolt barrels allow dimensional tolerance adjustments to be made through appropriate position corrections of the vacuum switch tubes.

Another advantageous embodiment of the invention provides the following features:

3.1 the insulating support devices are made of molded fiberglass-reinforced polyester material, and 3.2 the pole support device and the pole head device are made of a cast aluminum alloy.

This choice of materials allows the required mechanical and electrical characteristics for supporting the vacuum switch tubes in the containers to be met without difficulties.

BRIEF DESCRIPTION OF THE DRAWINGS

FIG. 3A shows a top plan view of an insulating support.

FIG. 3B shows a cross-sectional view of the insulating support taken along lines D—D illustrated in FIG. 3A.

FIG. 3C shows a front view of the insulating support illustrated in FIG. 3A.

FIG. 4 shows a cross-sectional view of the insulating support taken along lines A—A illustrated in FIG. 3A.

FIG. 5 shows a cross-sectional view of the insulating support taken along lines B—B illustrated in FIG. 3A.

DETAILED DESCRIPTION

Figure 1:
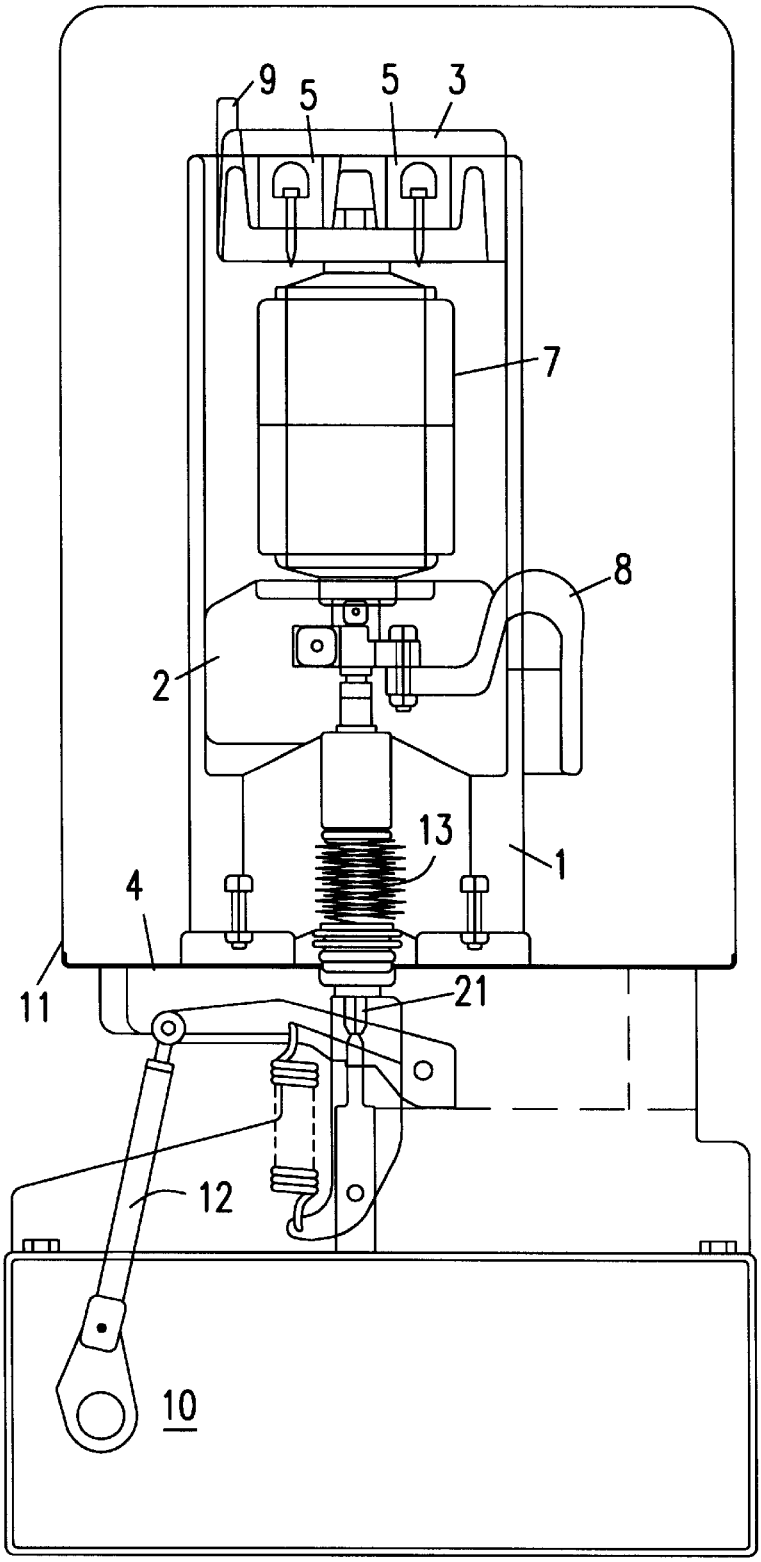
FIG. 1 shows a front view of the power switch module according to the present invention.

FIG. 1 shows only a portion of the container as partition 4. A gas chamber 11 is attached to the partition 4. Two symmetrically mounted insulating support devices 1, 1' (FIG. 2) are fastened via a threaded connection 31 to partition 4. Pole support device 2 and pole head device 3 are arranged between insulating support devices 1, 1' so that vacuum switch tubes 7 are supported radially by pole head device 3 in the outer end area, while vacuum switch tubes 7 are supported by pole support device 2 by abutment in the inner end area. Furthermore, the figure shows that flexible connector 8 is connected to pole support device 2 with fastening parts not specifically denoted, and flexible connector 8 is electrically conductively connected to conducting buses that are not specifically denoted. Furthermore, connecting device 9, electrically conductively connected to the conductor buses not represented, is provided on pole head device 3.

Figure 2:
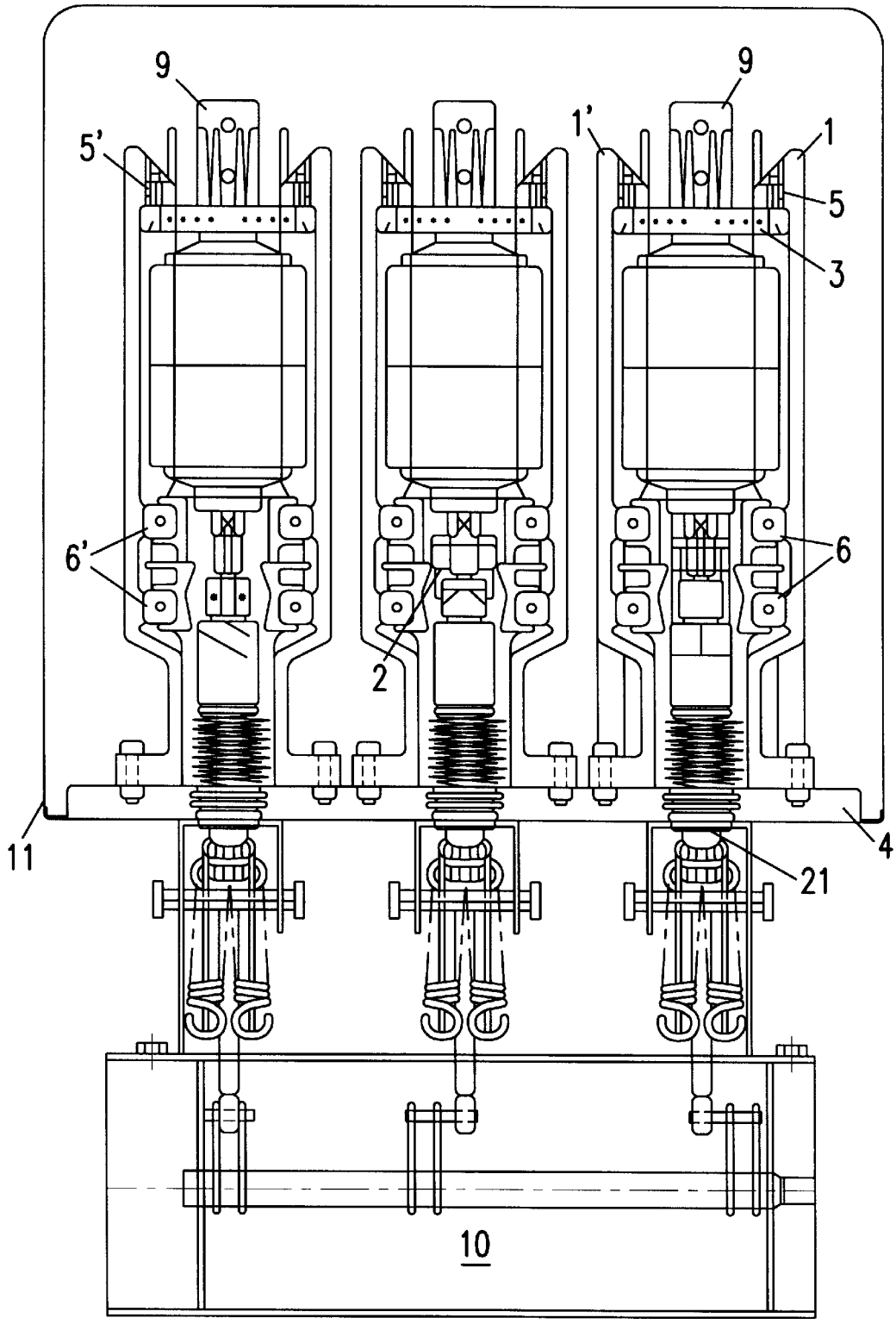
FIG. 2 shows a top view of three adjacent vacuum switch tubes mounted in the usual manner.

FIG. 2 shows the top view of three power switch modules distinguished by the symmetrical arrangement of insulating support devices 1, 1' on partition 4. Furthermore, the first and second screw beds 5, 5', 6, 6' are also facing one another symmetrically, but the first screw beds 5, 5' are inclined in relation to the second screw beds 6, 6' at a straight angle in the longitudinal direction. Vacuum switch tubes 7 (FIG. 1) are securely fastened between insulating support devices 1, 1' through this staggered arrangement of screw beds 5, 5' and 6, 6' in relation to one another. Drive 10, with whose help the rectilinearly movable actuating rods 12 can be moved within the gas-filled container (also not illustrated) is only shown schematically to complete the power switch module. The actuating rods 12 are sealed in a well-known manner against their surroundings in the container by bellows 21. The power supply buses are connected to the respective vacuum switch tubes via connecting device 9, while the current is supplied via flexible connector 8 (FIG. 1) through the buses (not illustrated) to the load insulating switch device (also not illustrated), and from there is fed to the outgoing power cable in the well-known manner.

FIGS. 3A–3C show insulating support device 1 with its flatbed-type extruded plastic piece 17 (shown in FIG. 4). The flatbed-type extruded plastic piece 17 is provided with a generally perpendicularly extending longitudinal boundary side 14, which provides the insulating support with a particularly high dimensional stability. The plastic extruded piece 14 has, as shown in FIG. 5, an inwardly crimped profile 19 fitting around the periphery of an actuator unit; this profile has a trapezoidal shape, as also shown in FIG. 5.

Furthermore, insulating support device 1 contains, in addition to first attachment arms 20, two first screw beds 5 and 5' arranged symmetrically in relation to the longitudinal axis.

The first screw beds 5 and 5' attach insulating support device 1 to the outer periphery of a container. Furthermore, insulating support device 1 is provided with second attachment arm 15, which also has two additional screw beds 18 arranged symmetrically in relation to the longitudinal axis. These screw beds 18 attach a radial support for the vacuum switch tubes mounted between the two symmetrically mounted insulating support devices 1. It can also be seen that insulating support device 1 has, on the inside, two second screw beds 6 and 6' (also shown in FIG. 2) arranged next to one another along a longitudinal axis, which are arranged shifted at a right angle in relation to additional screw beds 18 (FIG. 4). Second screw beds 6 and 6' accommodate the support of the vacuum switch tubes between insulating support devices 1.

We claim:

1. A power switch module mountable in a gas-filled container of gas-insulated switchgears, comprising:

a vacuum switch tube;

a rectilinearly movable actuating rod leading into the gas-filled container through a bellows-type seal; and two insulating support devices having identical profiles to accommodate and shield the vacuum switch tube, the insulating support devices arranged symmetrically about one part of a partition plate forming a portion of the gas-filled container, the insulating devices releasably fastened to the one part of the partition plate, the insulating support devices including:

two first screw beds having free ends, the first screw beds, via the free ends, arranged symmetrically with respect to a longitudinal axis of a respective one of the insulating support devices for fastening a pole head device which radially support the vacuum switch tube at an outer end area of the vacuum switch tube, and two adjacent second screw beds positioned in an inner area of the insulating support devices and opposite to one another with respect to the longitudinal axis for fastening a pole support device which supports the vacuum switch tube at an inner end area of the vacuum switch tube.

2. The power switch module according to claim 1, wherein the insulating support devices form a trapezoidal profile in an end area facing the partition plate, and wherein each of the first and second screw beds of the insulating support devices are provided with stops which semi-enclose a bolt barrel in the insulating support devices.

3. The power switch module according to claim 1, wherein the insulating support devices are composed of molded fiberglass-reinforced polyester material, and wherein the pole support device and the pole head device are composed of a cast aluminum alloy.

* * * * *